US009111696B1

(12) United States Patent
Puhalla et al.

(10) Patent No.: US 9,111,696 B1
(45) Date of Patent: Aug. 18, 2015

(54) ELECTRICAL SWITCHING APPARATUS, AND TRIP UNIT AND INTERFACE ASSEMBLY THEREFOR

(71) Applicant: EATON CORPORATION, Cleveland, OH (US)

(72) Inventors: Craig Joseph Puhalla, Moon Township, PA (US); David Raymond Rohn, Venetia, PA (US); Edward A. Prince, Aliquippa, PA (US); James Patrick Sisley, Baden, PA (US)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 14/336,057

(22) Filed: Jul. 21, 2014

(51) Int. Cl.

| | |
|---|---|
| ***H01H 9/16*** | (2006.01) |
| ***H01H 45/08*** | (2006.01) |
| ***H01H 9/00*** | (2006.01) |
| *H01H 50/08* | (2006.01) |
| *H01H 71/04* | (2006.01) |

(52) U.S. Cl.
CPC ..... *H01H 9/16* (2013.01); *H01H 9/0033* (2013.01); *H01H 45/08* (2013.01); *H01H 50/08* (2013.01); *H01H 71/04* (2013.01)

(58) Field of Classification Search
CPC ..... H01H 9/0033; H01H 9/16; H01H 45/08; H01H 50/08; H01H 63/04; H01H 71/04
USPC ..... 335/17
See application file for complete search history.

(56) References Cited

U.S. PATENT DOCUMENTS

| | | | | |
|---|---|---|---|---|
| 3,852,694 | A * | 12/1974 | Di Marco et al. | 337/62 |
| 4,095,075 | A * | 6/1978 | DiMarco | 200/308 |
| 4,536,758 | A * | 8/1985 | Schweitzer, Jr. | 340/664 |
| 6,144,271 | A | 11/2000 | Mueller et al. | |
| 6,747,534 | B1 | 6/2004 | Mueller et al. | |
| 2004/0008098 | A1 * | 1/2004 | Emura et al. | 335/17 |
| 2009/0154046 | A1 * | 6/2009 | Robinson et al. | 361/95 |

* cited by examiner

*Primary Examiner* — Mohammad Musleh
(74) *Attorney, Agent, or Firm* — Eckert Seamans Cherin & Mellott, LLC; Grant E. Coffield

(57) ABSTRACT

An interface assembly is for a trip unit of an electrical switching apparatus including a housing, separable contacts, and an operating mechanism for opening and closing the separable contacts. The trip unit cooperates with the operating mechanism and includes an enclosure, a controller, and a cover member having a plurality of indicia. The interface assembly includes at least one adjustment knob assembly having a post member and a ring member, which includes a cutout. The post member has first and second opposing ends. The ring member is disposed on the second end. The adjustment knob assembly pivots among a plurality of positions to adjust the controller. Each position corresponds to a predetermined setting of the trip unit. The ring member substantially overlays all but one of the indicia, which is exposed by the cutout to indicate the adjustment knob assembly position and corresponding trip unit setting.

20 Claims, 5 Drawing Sheets

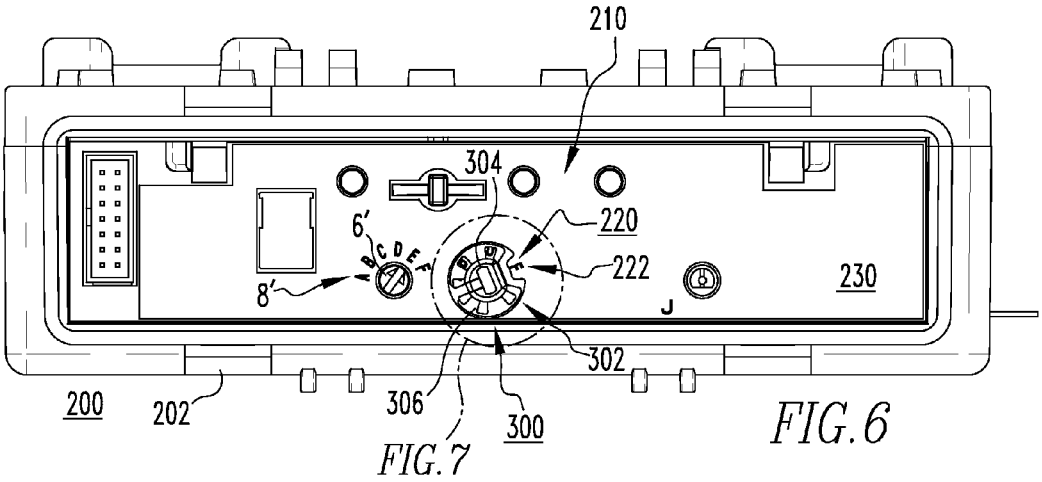
FIG. 6
FIG. 7
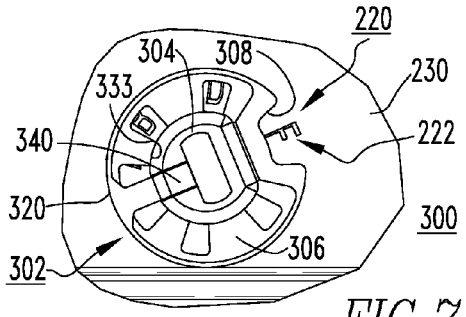
FIG. 7
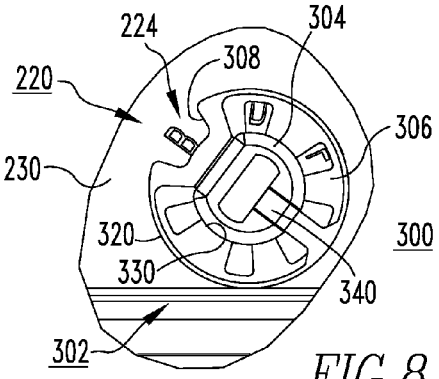
FIG. 8

ELECTRICAL SWITCHING APPARATUS, AND TRIP UNIT AND INTERFACE ASSEMBLY THEREFOR

BACKGROUND

1. Field

The disclosed concept relates generally to electrical switching apparatus and, more particularly, to electrical switching apparatus, such as circuit breakers. The disclosed concept also relates to trip units for circuit breakers. The disclosed concept further relates to interface assemblies for circuit breaker trip units.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

FIG. 1 shows a trip unit 2 having an interface assembly 4 with a number of adjustment knobs 6 (only one knob 6 is shown for ease of illustration)(see also, FIG. 2) that is accessible from the exterior of the circuit breaker (not shown). Due to space constraints, the adjustment knob(s) 6 is/are relatively small in size. The small size makes the adjustment knob(s) 6 difficult to see. Further, there is typically a significant amount of printed information 8 surrounding the adjustment knob(s) 6. For ease of illustration, only a limited amount of printed information 8 (see, for example, position indications "A," "B," "C," "D," "E," and "F") is shown in the example of FIGS. 1 and 2. It will be appreciated that there is typically a significant additional amount of printed information (not shown) on the label(s) 10 disposed on the interface assembly 4 around or near the adjustment knob(s) 6. This, in combination with the small knob size, makes accurately identifying the position of the knob(s) 6, and thus the setting of the trip unit 2, difficult. This is particularly true in relatively low light environments (e.g., without limitation, mining applications).

There is, therefore, room for improvement in electrical switching apparatus, such as circuit breakers, and in trip units and interface assemblies therefor.

SUMMARY

These needs and others are met by embodiments of the disclosed concept, which are directed to an interface assembly for a trip unit of an electrical switching apparatus.

As one aspect of the disclosed concept, an interface assembly is provided for a trip unit of an electrical switching apparatus. The trip unit comprises an enclosure, a controller enclosed by the enclosure, and a cover member coupled to the enclosure. The cover member includes a plurality of indicia. The electrical switching apparatus comprises a housing having an interior and an exterior, separable contacts disposed in the interior, and an operating mechanism for opening and closing the separable contacts. The trip unit is adapted to cooperate with the operating mechanism. The interface assembly comprises: at least one adjustment knob assembly comprising a post member and a ring member, the ring member including a cutout, the post member including a first end structured to cooperate with the controller and a second end disposed opposite and distal from the first end, the ring member being disposed on the second end. The adjustment knob assembly is structured to pivot among a plurality of positions to correspondingly adjust the controller. Each of the positions corresponds to a predetermined setting of the trip unit. The ring member is structured to substantially overlay all but one of the plurality of indicia. The cutout is structured to expose one of the plurality of indicia, thereby indicating the position of the at least one adjustment knob assembly and the corresponding predetermined setting of the trip unit.

The post member may have a first diameter and the ring member may have a second diameter, wherein the second diameter of the ring member is greater than the first diameter of the post member.

As another aspect of the disclosed concept, a trip unit is provided for an electrical switching apparatus. The electrical switching apparatus comprises a housing having an interior and an exterior, separable contacts disposed in the interior, and an operating mechanism for opening and closing the separable contacts. The trip unit comprises: an enclosure; a controller enclosed by the enclosure; a cover member coupled to the enclosure, the cover member including a plurality of indicia; and an interface assembly comprising: at least one adjustment knob assembly comprising a post member and a ring member, the ring member including a cutout, the post member including a first end cooperating with the controller and a second end disposed opposite and distal from the first end, the ring member being disposed on the second end. The adjustment knob assembly pivots among a plurality of positions to correspondingly adjust the controller. Each of the positions corresponds to a predetermined setting of the trip unit. The ring member substantially overlays all but one of the plurality of indicia. The cutout exposes one of the plurality of indicia, thereby indicating the position of the at least one adjustment knob assembly and the corresponding predetermined setting of the trip unit.

As a further aspect of the disclosed concept, an electrical switching apparatus comprises: a housing having an interior and an exterior; separable contacts disposed in the interior; an operating mechanism for opening and closing the separable contacts; and a trip unit comprising: an enclosure, a controller enclosed by the enclosure, a cover member coupled to the enclosure, the cover member including a plurality of indicia, and an interface assembly comprising: at least one adjustment knob assembly comprising a post member and a ring member, the ring member including a cutout, the post member including a first end cooperating with the controller and a second end disposed opposite and distal from the first end, the ring member being disposed on the second end. The adjustment knob assembly pivots among a plurality of positions to correspondingly adjust the controller. Each of the positions corresponds to a predetermined setting of the trip unit. The ring member substantially overlays all but one of the plurality of indicia. The cutout exposes one of the plurality of indicia, thereby indicating the position of the at least one adjustment knob assembly and the corresponding predetermined setting of the trip unit.

BRIEF DESCRIPTION OF THE DRAWINGS

A full understanding of the disclosed concept can be gained from the following description of the preferred embodiments when read in conjunction with the accompanying drawings in which:

FIG. 6 is a plan view of the trip unit, with the adjustment knob assembly of the interface assembly indicating a first position;

FIG. 7 is an enlarged view of the interface assembly and adjustment knob assembly of FIG. 6; and FIG. 8 is a plan view of the trip unit, modified to show the adjustment knob assembly of the interface assembly indicating another, different position.

DESCRIPTION OF THE PREFERRED EMBODIMENTS

Figure 1:
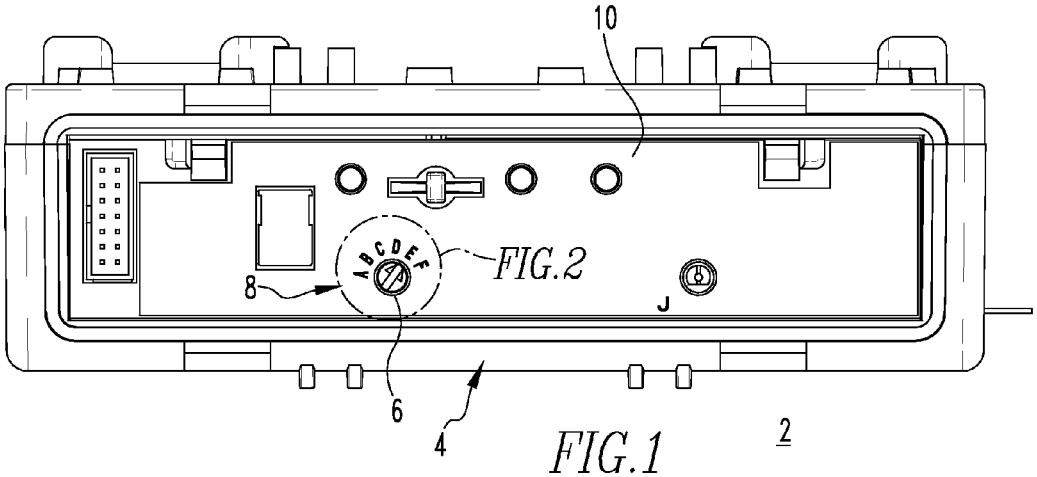
FIG.1 PRIOR ART
FIG. 1 is a plan view of a prior art trip unit, and interface assembly and adjustment knob therefor.

Directional phrases used herein, such as, for example, clockwise, counterclockwise and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
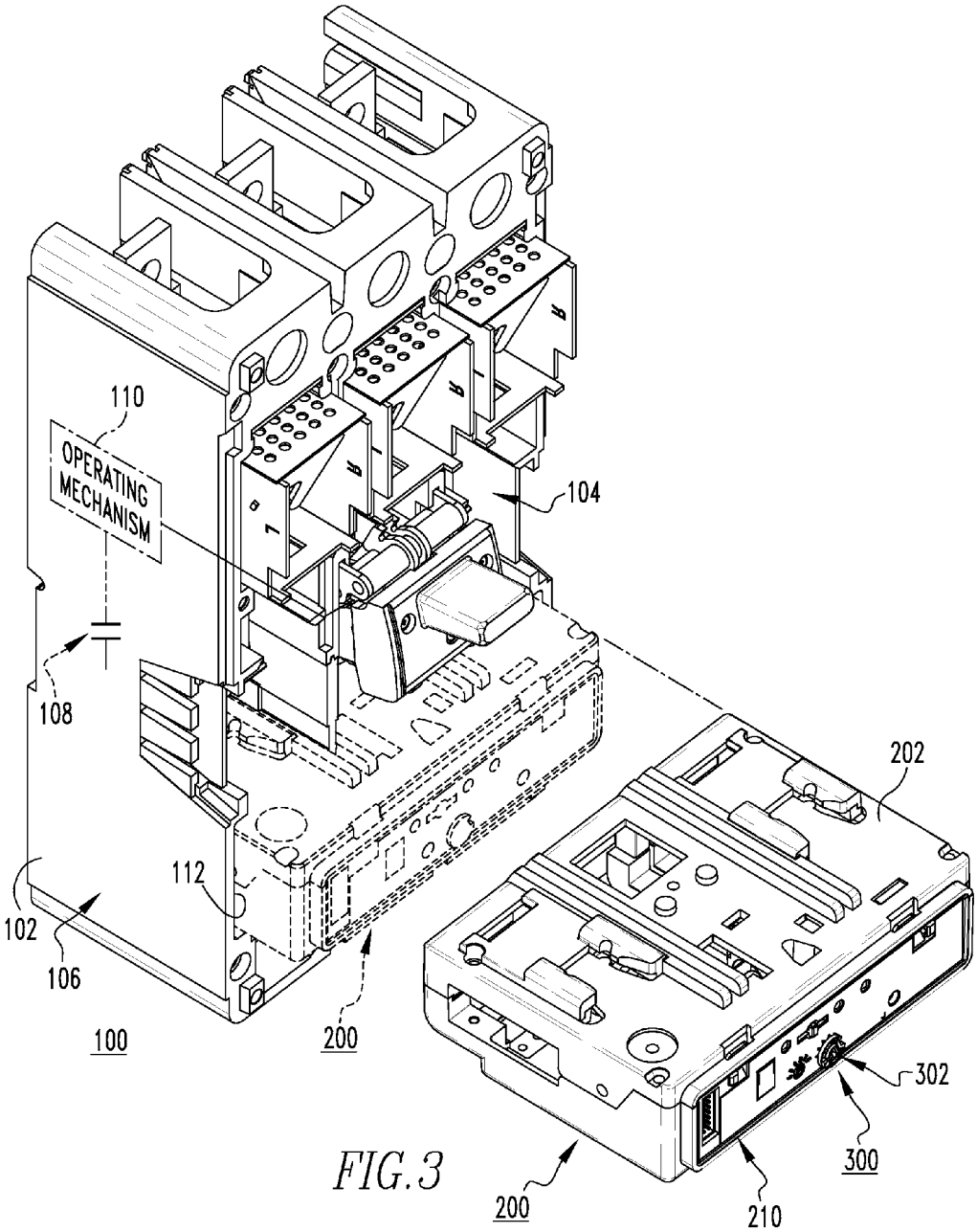
FIG. 3 is an isometric partially exploded view showing a circuit breaker, and trip unit and interface assembly therefor, in accordance with an embodiment of the disclosed concept.

Referring to FIG. 3, an electrical switching apparatus 100 (e.g., without limitation, circuit breaker) is partially shown. The circuit breaker 100 includes a trip unit 200 having an interface assembly 300 in accordance with one non-limiting example embodiment of the disclosed concept. The circuit breaker 100 includes a housing 102 having an interior 104 and an exterior 106. Separable contacts 108 (shown in simplified form in FIG. 3) are disposed in the interior 104. An operating mechanism 110 (shown in simplified form in phantom line drawing in FIG. 3) is adapted to open and close the separable contacts 108, for example, in response to an electrical fault condition. The trip unit 200 in the example shown and described herein, is structured to be removably disposed within a cavity 112 of the circuit breaker housing 102, as shown in phantom line drawing in FIG. 3. Thus, it will be appreciated that a portion (e.g., cover (not shown)) of the circuit breaker 100 is removed in FIG. 3 to show internal structures. It will also be appreciated that the interface assembly 300, in accordance with the disclosed concept, could be employed with any known or suitable alternative electrical switching apparatus (not shown) and/or trip unit (not shown) therefor, other than the example circuit breaker 100 and trip unit 200, without departing from the scope of the disclosed concept.

Figure 4:
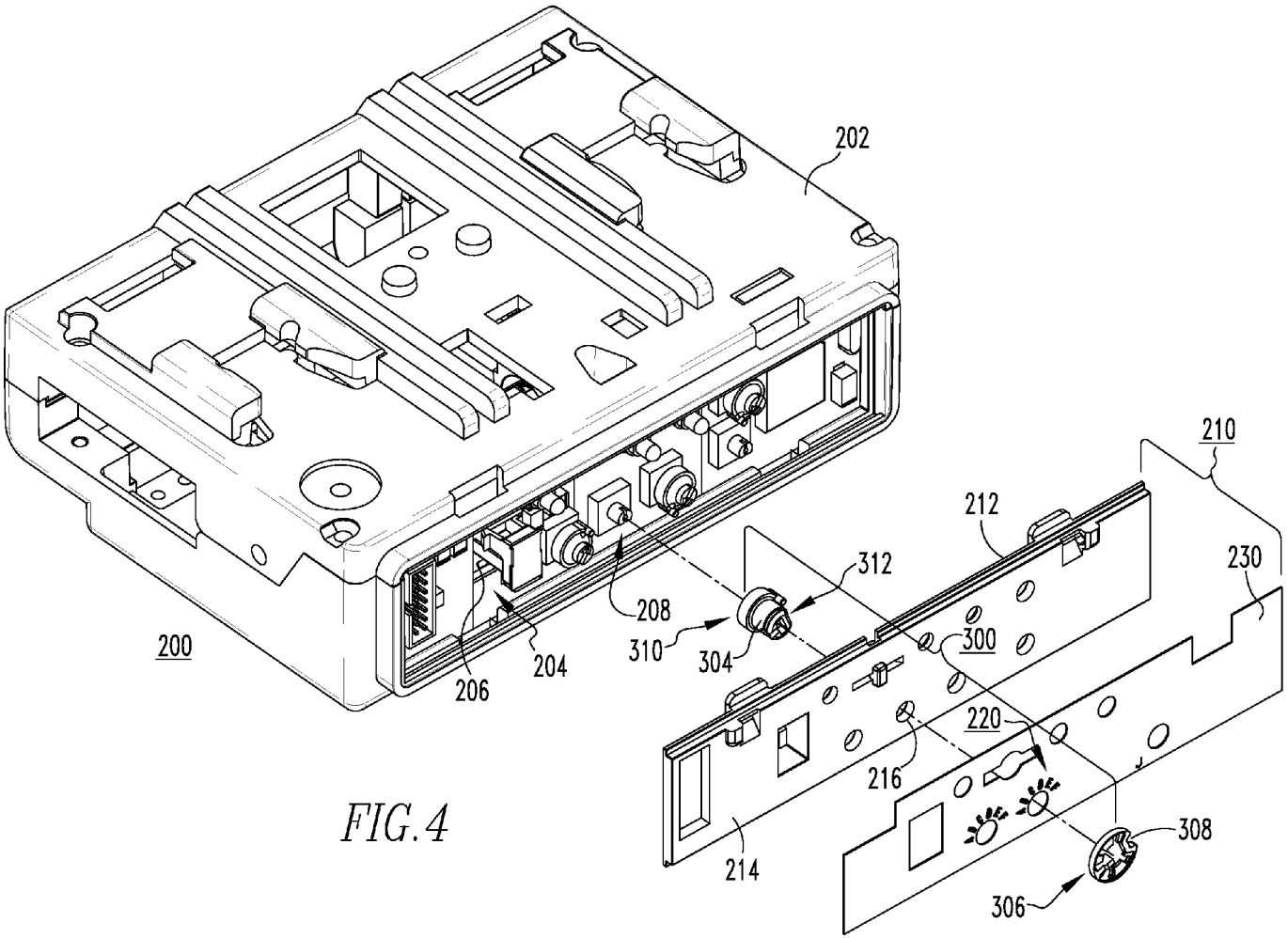
FIG. 4 is an exploded isometric view of the trip unit and interface assembly therefor of FIG. 3.

Continuing to refer to FIG. 3, and also to FIG. 4, the trip unit 200 includes an enclosure 202, a controller 204 (FIG. 4) enclosed by enclosure 202, and a cover member 210 coupled to the enclosure 202. In the example shown and described herein, the controller 204 comprises a printed circuit board (PCB) 206 (partially shown in FIG. 4) and an adjustment switch 208 in communication with the PCB 206. As best shown in FIG. 4, the cover member 210 includes a first side 212, a second side 214 opposite the first side 212, and a thru hole 216 extending through the cover member 210. A plurality of indicia 220 are disposed on the cover member 210. More specifically, in the example shown and described herein, the cover member 210 includes a label 230, which is structured to be adhered to the second side 214 of the cover member 210. The plurality of indicia 220 includes a plurality of letters or numbers (see, for example and without limitation, position indications "A," "B," "C," "D," "E," and "F") printed on the label 230 proximate the aforementioned thru hole 216.

Figure 5:
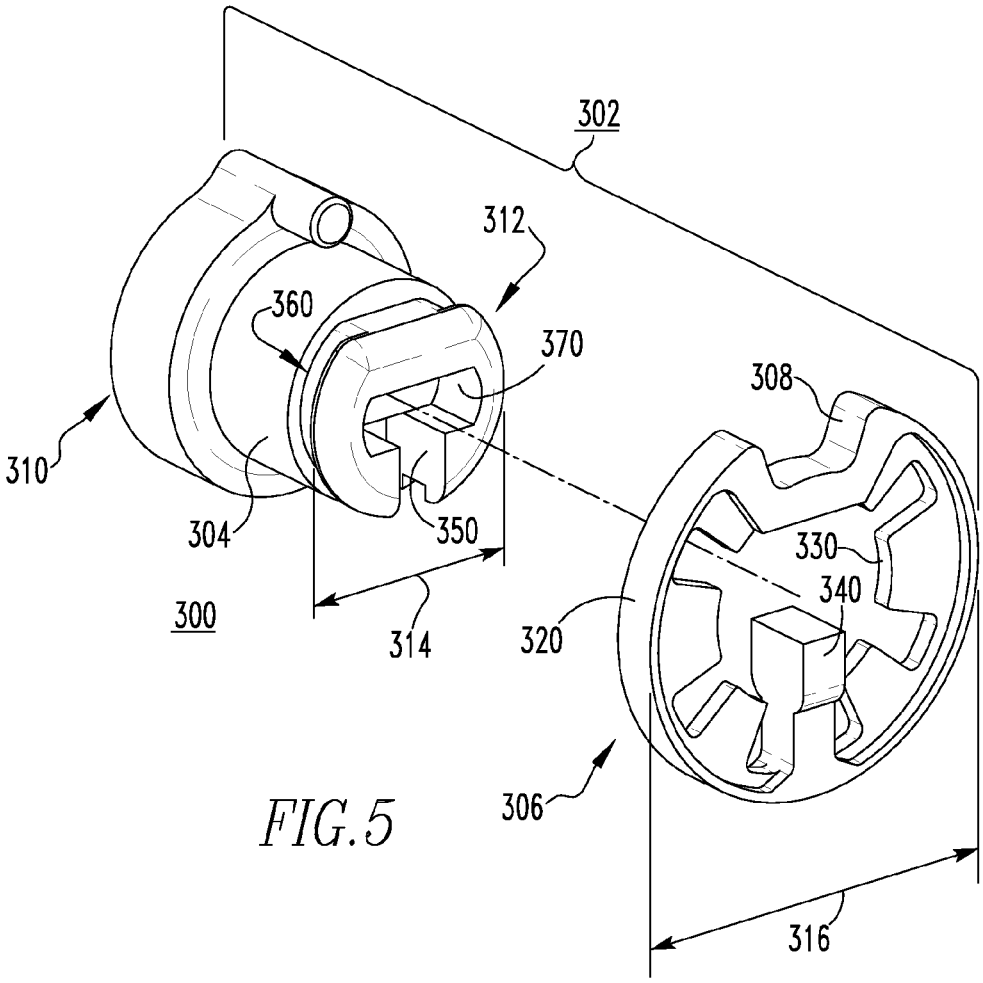
FIG. 5 is an exploded isometric view of an adjustment knob assembly for the interface assembly of FIG. 4.

The interface assembly 300 includes at least one adjustment knob assembly 302. As best shown in FIG. 5, the adjustment knob assembly 302 includes a post member 304 and a ring member 306. The ring member 306 includes a cutout 308. The post member 304 has first and second opposing ends 310,312. The first end 310 is structured to cooperate with the controller 204 and, in particular, to be coupled to the aforementioned adjustment switch 208, as shown in FIG. 4. Thus, the first end 310 of the post member 304 is disposed on the first side 212 of the cover member 210. The post member 304 then extends through the thru hole 216 in the cover member 210, and the ring member 306 is coupled to the second end 312 of the post member 304 on the second side 214 of the cover member 210.

Accordingly, the adjustment knob assembly 302 is structured to pivot (e.g., without limitation, clockwise; counterclockwise) among a plurality of positions (see, for example and without limitation, position "F" 222, shown in FIGS. 6 and 7, and position "B" 224, shown in FIG. 8) to correspondingly adjust the controller 204 (FIG. 4). As previously discussed, each of the positions (see, for example and without limitation, positions "A," "B," "C," "D," "E," and "F" (all shown in FIG. 4)) corresponds to a predetermined setting of the trip unit 200.

As best shown in FIGS. 6-8, the ring member 306 of the disclosed adjustment knob assembly 302 is structured to substantially overlay all but one of the plurality of indicia 220 printed on label 230) or otherwise disposed on the cover member 210. Accordingly, it will be appreciated that the aforementioned cutout 308 of the ring member 306 is structured to expose only one of the plurality of indicia 220, thereby clearly indicating the position of the adjustment knob assembly 302 and the corresponding predetermined setting of the trip unit 200. By way of one non-limiting operational example, in FIGS. 6 and 7 the cutout 308 of ring member 306 is exposing the letter "F" 222, while all of the other indicia 220 (i.e., letters "A," "B," "C," "D," and "E") are substantially covered by the ring member 306, as shown. In FIG. 8, the adjustment knob assembly 302 has been pivoted (e.g., without limitation, rotated counterclockwise) to a different position wherein the cutout 308 of the ring member 306 exposes only letter "B" 224, and all of the other indicia 220 (i.e, letters "A," "B," "C," "D," "E," and "F") are substantially covered by the ring member 306.

Figure 2:
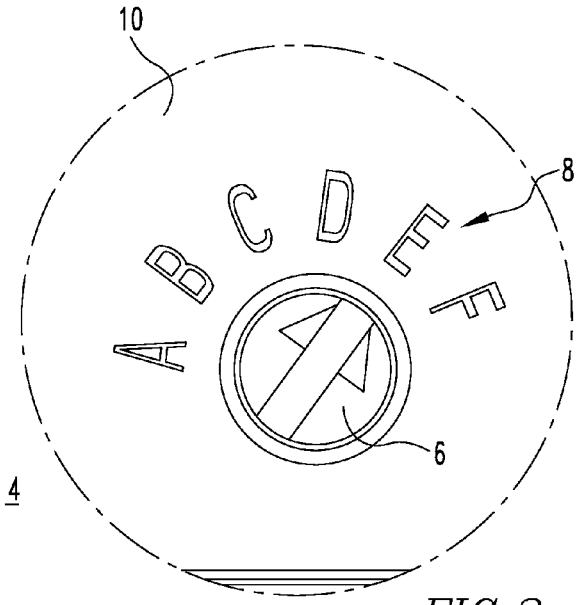
FIG.2 PRIOR ART
FIG. 2 is an enlarged view of the adjustment knob of FIG. 1.

Accordingly, it will be appreciated that the post member 304 of the interface assembly 300 has a first diameter 314 and the ring member 306 has a second diameter 316 (both shown in FIG. 5). The second diameter 316 of the ring member 306 is greater than the first diameter 314 of the post member 304 such that the ring member 306 substantially overlays (i.e., covers) all but one of the plurality of indicia 220, as previously discussed and shown, for example, with reference to FIGS. 6-8. In other words, the disclosed interface assembly 300 advantageously makes identifying the position of the adjustment knob assembly 302 much clearer than prior art designs (see, for example, FIGS. 1 and 2) by substantially covering all other information on the printed label 230 that does not pertain to the position of the adjustment knob assembly 302. This will be further appreciated, for example, with reference to the conventional adjustment knob 6' and exposed indicia 8' (e.g., without limitation, letters "A" through "F") as compared to the new interface assembly 300 in accordance with the disclosed concept, shown next to the adjustment knob 6' in FIG. 6. Accordingly, among other benefits, the cutout 308 of the ring member 306 functions as a window that exposes only the information on the printed label 230 that is pertinent to the trip unit settings, therefore reducing the amount of information seen by the end user and making it more simple to read and use. Additionally, the new adjustment knob assembly 302 allows for application of the disclosed interface assembly 300 after the circuit breaker 100 (FIG. 3), trip unit 200 (FIGS. 3, 4 and 6), or other suitable electrical switching apparatus or component (not shown) has/have been assembled. This advantageously reduces manufacturing costs and simplifies assembly.

The disclosed adjustment knob assembly 302 also overcomes several other disadvantages associated with prior art designs. For example and without limitation, in the conventional adjustment knob design shown in FIGS. 1 and 2, the slot and arrowhead in the adjustment knob 6 tend to get damaged (e.g., disfigured) after extended use. When this occurs, it is difficult to tell which way the arrow of the adjustment knob 6 is pointing. Thus, the trip unit setting can be off by 180 degrees from the intended position and corresponding setting. The instant interface assembly 300 and adjustment knob assembly 302 therefor overcome this and other disadvantages.

Referring again to FIG. 5, the ring member 306 is a generally circular planar member having an outer perimeter 320. The aforementioned cutout 308 extends inwardly from the outer perimeter 320 to create a recess or window 308, as previously discussed hereinabove. The ring member 306 further includes a central opening 330 and a projection 340 projecting into the central opening 330, as shown. The projection 340 has a shape, and the second end 312 of the post member 304 includes a recess 350 having a shape which corresponds to the shape of the projection 340. The projection 340 is disposed in the recess 350, thereby maintaining the ring member 306 in a predetermined fixed orientation with respect to the post member 304. Stated another way, the ring member 306 is "keyed" with respect to the post member 304 such that the components are disposed in and maintain the desired orientation with respect to one another. Thus, the ring member 306 moves with, but not independently with respect to, the post member 304. The example ring member 306 is structured to snap fit to the post member 304 to securely couple the ring member 306 to the post member 304, without the use of a number of separate fasteners (not shown). More specifically, the post member 304 in the example shown includes a lip or collar 360 which cooperates with the ring member 306 at or about the central opening 330 thereof to create the desired snap fit. It will, however, be appreciated that the post member 304 and/or ring member 306 of the disclosed interface assembly 300 could have any known or suitable alternative shape and/or configuration (not shown), and could be suitably coupled together using any known or suitable alternative mechanism (not shown) or configuration (not shown), without departing from the scope of the disclosed concept.

In the example shown and described herein, the second end 312 of the example post member 304 also includes an elongated slot 370. Such elongated slot 370 can be used, for example and without limitation, to receive a screwdriver (not shown) or other known or suitable tool (not shown) to facilitate moving (e.g., without limitation, pivoting clockwise or counterclockwise) the adjustment knob assembly 302 to correspondingly adjust the trip unit 200.

Accordingly, the disclosed interface assembly 300 provides a relatively simple (e.g., without limitation, low-cost) yet effective mechanism for improving the ability to read and determine the status (e.g., without limitation, positions; setting) of an electrical component (e.g., without limitation, trip unit 200) by substantially limiting the amount of information (e.g., without limitation, plurality of indicia 220) that is seen, and must be interpreted by, the end user. Thus, the interface assembly 300 advantageously makes the adjustment knob assembly 302 more simple for the end user to read and accurately operate.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. An interface assembly for a trip unit of an electrical switching apparatus, said trip unit comprising an enclosure, a controller enclosed by the enclosure, and a cover member coupled to the enclosure, said cover member including a plurality of indicia, said electrical switching apparatus comprising a housing having an interior and an exterior, separable contacts disposed in the interior, and an operating mechanism for opening and closing said separable contacts, said trip unit being adapted to cooperate with said operating mechanism, said interface assembly comprising:

at least one adjustment knob assembly comprising a post member and a ring member, said ring member including a cutout, said post member including a first end structured to cooperate with said controller and a second end disposed opposite and distal from the first end, said ring member being disposed on the second end, wherein said at least one adjustment knob assembly is structured to pivot among a plurality of positions to correspondingly adjust said controller, wherein each of said positions corresponds to a predetermined setting of said trip unit, wherein said ring member is structured to substantially overlay all but one of said plurality of indicia, and wherein said cutout is structured to expose said one of said plurality of indicia, thereby indicating said position of said at least one adjustment knob assembly and the corresponding predetermined setting of said trip unit.

2. The interface assembly of claim 1 wherein said post member has a first diameter; wherein said ring member has a second diameter; and wherein the second diameter of said ring member is greater than the first diameter of said post member.

3. The interface assembly of claim 1 wherein said ring member is a generally circular planar member having an outer perimeter; and wherein said cutout extends inwardly from the outer perimeter to create a recess or window.

4. The interface assembly of claim 1 wherein said cover member includes a first side, a second side and a thru hole; wherein the first end of said post member is structured to be disposed on the first side of said cover member; wherein said post member is structured to extend through said thru hole; and wherein said ring member is structured to be coupled to the second end of said post member on the second side of said cover member.

5. The interface assembly of claim 4 wherein said ring member includes a central opening and a projection projecting into the central opening; wherein said projection has a shape; wherein the second end of said post member includes a recess corresponding to the shape of said projection; and wherein said projection is disposed in said recess thereby maintaining said ring member in a predetermined fixed orientation with respect to said post member.

6. The interface assembly of claim 5 wherein said projection is snap fit to said post member to couple said ring member to said post member, without the use of a number of separate fasteners.

7. The interface assembly of claim 5 wherein the second end of said post member further includes an elongated slot configured to receive a screwdriver or tool for pivoting and adjusting said adjustment knob assembly.

8. A trip unit for an electrical switching apparatus, said electrical switching apparatus comprising a housing having an interior and an exterior, separable contacts disposed in the interior, and an operating mechanism for opening and closing said separable contacts, said trip unit comprising:

an enclosure;

a controller enclosed by the enclosure;

a cover member coupled to the enclosure, said cover member including a plurality of indicia; and an interface assembly comprising:

at least one adjustment knob assembly comprising a post member and a ring member, said ring member including a cutout, said post member including a first end cooperating with said controller and a second end disposed opposite and distal from the first end, said ring member being disposed on the second end, wherein said at least one adjustment knob assembly pivots among a plurality of positions to correspondingly adjust said controller, wherein each of said positions corresponds to a predetermined setting of said trip unit, wherein said ring member substantially overlays all but one of said plurality of indicia, and wherein said cutout exposes said one of said plurality of indicia, thereby indicating said position of said at least one adjustment knob assembly and the corresponding predetermined setting of said trip unit.

9. The trip unit of claim 8 wherein said post member has a first diameter; wherein said ring member has a second diameter; and wherein the second diameter of said ring member is greater than the first diameter of said post member.

10. The trip unit of claim 8 wherein said controller comprises a printed circuit board and an adjustment switch; wherein said cover member includes a first side, a second side and a thru hole; wherein the first end of said post member is coupled to said adjustment switch on the first side of said cover member; wherein said post member extends through said thru hole; and wherein said ring member is coupled to the second end of said post member on the second side of said cover member.

11. The trip unit of claim 10 wherein said plurality of indicia is a plurality of letters or numbers disposed on the second side of said cover member proximate said thru hole; wherein each of said letters or numbers corresponds to a corresponding one of the predetermined settings of said trip unit; wherein said ring member is a generally circular planar member having an outer perimeter; and wherein said cutout extends inwardly from the outer perimeter to create a recess or window for exposing a corresponding one of said letters or numbers.

12. The trip unit of claim 10 wherein said ring member includes a central opening and a projection projecting into the central opening; wherein said projection has a shape; wherein the second end of said post member includes a recess corresponding to the shape of said projection; and wherein said projection is disposed in said recess thereby maintaining said ring member in a predetermined fixed orientation with respect to said post member.

13. The trip unit of claim 12 wherein said projection is snap fit to said post member to couple said ring member to said post member, without the use of a number of separate fasteners.

14. The trip unit of claim 12 wherein the second end of said post member further includes an elongated slot configured to receive a screwdriver or tool for pivoting and adjusting said adjustment knob assembly.

15. An electrical switching apparatus comprising:

a housing having an interior and an exterior;

separable contacts disposed in the interior;

an operating mechanism for opening and closing said separable contacts; and a trip unit comprising:

an enclosure, a controller enclosed by the enclosure, a cover member coupled to the enclosure, said cover member including a plurality of indicia, and an interface assembly comprising:

at least one adjustment knob assembly comprising a post member and a ring member, said ring member including a cutout, said post member including a first end cooperating with said controller and a second end disposed opposite and distal from the first end, said ring member being disposed on the second end, wherein said at least one adjustment knob assembly pivots among a plurality of positions to correspondingly adjust said controller, wherein each of said positions corresponds to a predetermined setting of said trip unit, wherein said ring member substantially overlays all but one of said plurality of indicia, and wherein said cutout exposes said one of said plurality of indicia, thereby indicating said position of said at least one adjustment knob assembly and the corresponding predetermined setting of said trip unit.

16. The electrical switching apparatus of claim 15 wherein said post member has a first diameter; wherein said ring member has a second diameter; and wherein the second diameter of said ring member is greater than the first diameter of said post member.

17. The electrical switching apparatus of claim 15 wherein said controller comprises a printed circuit board and an adjustment switch; wherein said cover member includes a first side, a second side and a thru hole; wherein the first end of said post member is coupled to said adjustment switch on the first side of said cover member; wherein said post member extends through said thru hole; and wherein said ring member is coupled to the second end of said post member on the second side of said cover member.

18. The electrical switching apparatus of claim 17 wherein said plurality of indicia is a plurality of letters or numbers disposed on the second side of said cover member proximate said thru hole; wherein each of said letters or numbers corresponds to a corresponding one of the predetermined settings of said trip unit; wherein said ring member is a generally circular planar member having an outer perimeter; and wherein said cutout extends inwardly from the outer perimeter to create a recess or window for exposing a corresponding one of said letters or numbers.

19. The electrical switching apparatus of claim 17 wherein said ring member includes a central opening and a projection projecting into the central opening; wherein said projection has a shape; wherein the second end of said post member includes a recess corresponding to the shape of said projection; and wherein said projection is disposed in said recess thereby maintaining said ring member in a predetermined fixed orientation with respect to said post member.

20. The electrical switching apparatus of claim 15 wherein said electrical switching apparatus is a circuit breaker; wherein the housing of said circuit breaker includes a cavity extending from the exterior to the interior; wherein said trip unit is removably disposed within said cavity; and wherein, when said trip unit is disposed in said cavity, said interface assembly is accessible from the exterior of the housing.

* * * * *